United States Patent [19]

Notelteirs

[11] 4,370,587

[45] Jan. 25, 1983

[54] LAMP/REFLECTOR UNIT

[75] Inventor: Victor R. Notelteirs, Eindhoven, Netherlands

[73] Assignee: U.S. Philips Corporation, New York, N.Y.

[21] Appl. No.: 208,969

[22] Filed: Nov. 21, 1980

[30] Foreign Application Priority Data

Dec. 21, 1979 [NL] Netherlands ..... 7909231

[51] Int. Cl.[3] ..... H01J 5/16; H01J 61/40

[52] U.S. Cl. ..... 313/113

[58] Field of Search ..... 313/113, 115

[56] References Cited

U.S. PATENT DOCUMENTS 4,039,878 8/1977 Eijkelenboom et al. ..... 313/113

4,156,271 5/1979 Vercellotti ..... 313/113 X 4,316,240 2/1982 Pitkjaan et al. ..... 313/113 X

*Primary Examiner*—Robert Segal

*Attorney, Agent, or Firm*—Robert S. Smith

[57] ABSTRACT

In a lamp/reflector unit according to the invention the pinch seal (6) of an electric lamp (4) is enclosed laterally between moulded members (10, 11) and accommodated with said moulded members (10, 11) in the necked portion (2) of a reflector body (1). The surface of the pinch seal (6) has a groove (12) which is in engagement with rib (13) on one of the moulded members (10) and keeps the lamp (4) locked against axial movement. The necked portion (2) of the reflector body (1) keeps the lamp (4) with the moulded members (10, 11) fixed.

7 Claims, 9 Drawing Figures

LAMP/REFLECTOR UNIT

Figure 1:
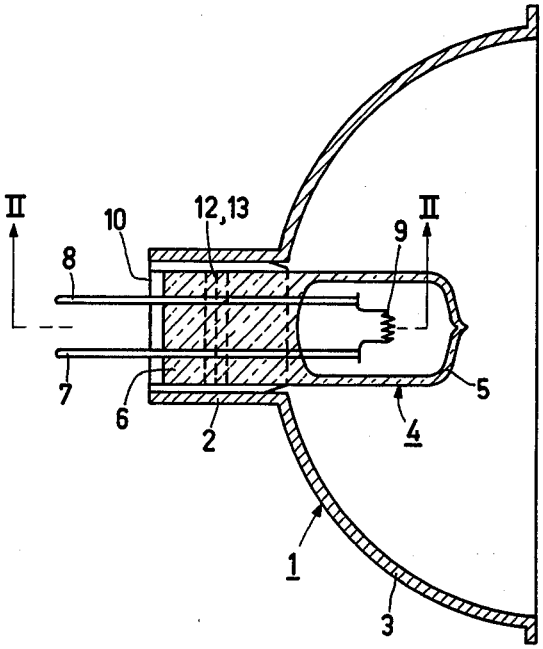

The invention relates to a lamp/reflector unit comprising a metal reflector body having a necked portion near the apex of a concave reflecting portion and also comprising an electric lamp having a glass lamp envelope with a pinch seal in which current supply conductors are embedded which extend from outside the lamp envelope to an electric element accommodated inside the lamp envelope, which pinch seal is fixed in the necked portion of the reflector body. Such a unit is known from British Patent Specification No. 1,528,646.

In said known unit, the pinch seal of the lamp envelope is fixed in the neck-shaped portion of the reflector body by means of cement. However, the use of cement has the disadvantage that the lamp must be kept aligned with respect to the reflector body for a considerable period of time before the cement has hardened to such an extent that the lamp can no longer more relative to the reflector body. Another disadvantage of cement is that it easily creeps over molybdenum. When molybdenum current supply conductors are used which serve for connection to the contact terminals of a current source, a good electric contact is often prevented by the cement.

It is the object of the invention to provide a lamp/reflector unit having a construction which enables a rapid and easy assembly of the unit.

In a lamp/reflector unit of the kind mentioned in the opening paragraph this object is achieved in that the pinch seal of the lamp envelope is enclosed laterally between at least two moulded members, the surface of the pinch seal is provided with a profiled portion which is in engagement with a counter-profiled portion on at least one of the moulded members and keeps the lamp locked against axial movement and that the necked portion of the reflector body keeps the lamp with the moulded members fixed in the reflector body.

The electric lamp may be a discharge lamp, in which case a pair of electrodes accommodated in the lamp envelope forms the said electric element, or it may be an incandescent lamp, in particular a halogen incandescent lamp, in which case the electric element is a filament. The lamp envelope may consist of hard glass, for example alkalialuminoborosilicate glass or a type of glass having a very high silicon dioxide content of at least 95% by weight, for example quartz glass.

The profiled portion of the surface of the pinch seal may consist of one or more grooves, one or more ribs, or a combination thereof. Such a portion may be present on one or more side faces of the pinch seal. Halogen incandescent lamps having such a profile on the pinch surface are described in British Patent Specification No. 1,536,649 and British Patent Application No. 7,923,344. In those lamps the filament has an accurately-determined location with respect to the profile on the pinch seal. In those lamps the current supply conductors projecting from the lamp envelope are bent back along the surface of the pinch seal, since the lamps are destined to be placed in a lamp holder without their having a lamp cap.

The moulded members are shaped so that together they laterally enclose the pinch seal of the lamp envelope. For that purpose they will together surround the pinch seal over an angle of substantially 360°. Between the moulded members provided around the pinch seal, however, gaps may be provided which make it possible to surround the pinch seal in a clamping manner. The moulded members may surround the pinch seal over a part of its length, viewed in the axial direction of the lamp envelope, or over its entire length. It is possible for the moulded members in the assembled unit to project beyond the free end of the necked portion of the reflector body.

For the moulded members a selection may be made from a variety of materials, for example: metals such as brass and aluminium, electrically insulating materials such as ceramic materials, for example steatite, and synthetic resins, in particular the synthetic resins which can withstand higher temperatures, for example 200° C. or higher, silicon resins such as polyphenylmethyl siloxane, and polyamides and polyamide-imides, for example those based on pyromellitic acid.

The assembly of the lamp/reflector unit is simplest when the lamp, after the moulded members have been provided around the pinch seal, with its electric element is introduced into the concave, reflecting portion via the necked portion of the reflector body.

In an embodiment at least one of the moulded members has a projection, for example an edge, which abuts against the free end of the neck-shaped portion of the reflector body, so that the distance over which the lamp together with the moulded members can be moved through the necked portion into the reflecting portion is limited.

If the neck-shaped portion of the reflector body surrounds the moulded members in a clamping manner, no additional measures need be taken to keep the lamp together with the moulded members fixed in the reflector body. However, a favourable alternative is a fixing obtained by locally intending the necked portion, for example, to form recesses in the outer surface of the moulded members.

In an embodiment, the moulded members clamp around the current supply conductors of the lamp beyond the lamp envelope. This embodiment presents the possibility of connecting an electric cable to the current supply conductors emanating from the lamp envelope and to mechanically relieve the connection place by means of the moulded members. The possibility is also presented to connect plug pins instead of a cable, said pins having a diameter and/or being of a metal which cannot be incorporated directly in the pinch seal without giving rise to fracture of the pinch. In that case too it is possible to relieve the connection mechanically. In this embodiment the sealing of the current supply conductors in the pinch seal is relieved mechanically.

In a further embodiment the moulded members are coupled together by one or more recesses and ribs which engage into each other.

The lamp/reflector unit according to the invention can be used inter alia as a spotlight, for example for giving accent illumination.

Figure 4:
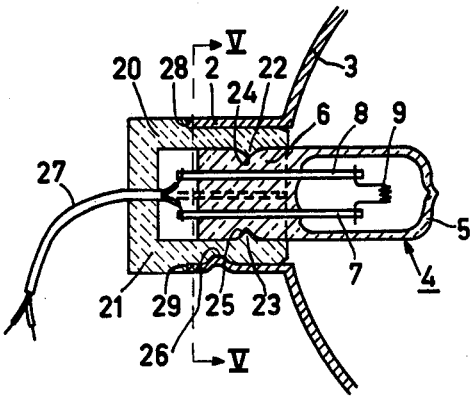
Figure 5:
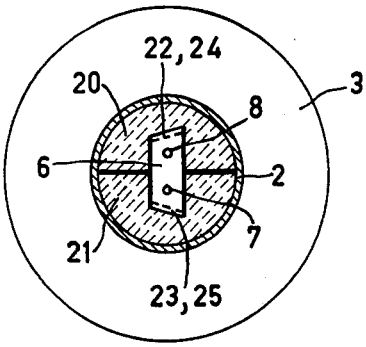
Figure 6:
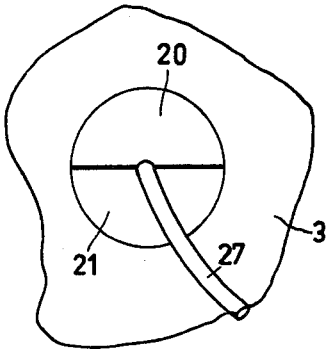
Figure 7:
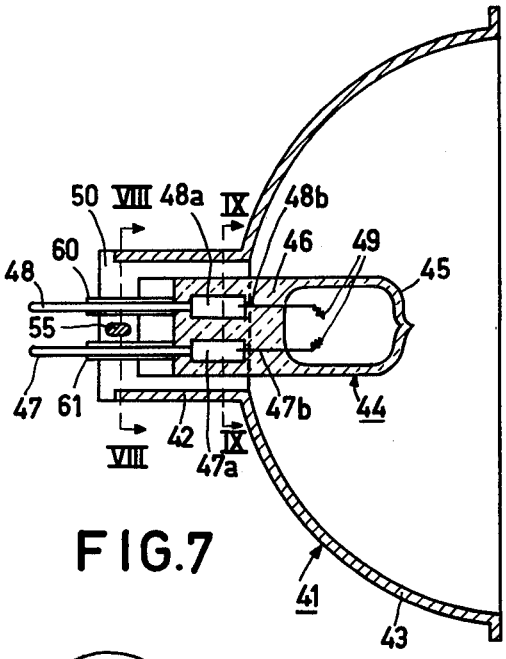
Figure 8:
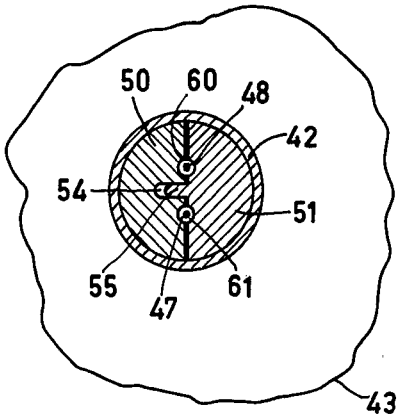
Figure 9:
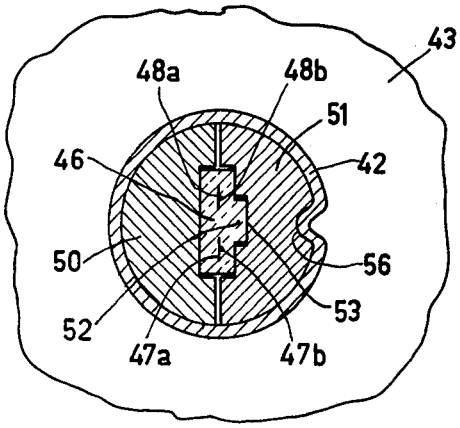

Embodiments of the lamp/reflector unit according to the invention are shown in the drawing. In the drawing FIG. 1 is an axial sectional view through a first embodiment of a unit, FIG. 2 is an axial sectional view taken on the line II—II of the same unit, FIG. 3 is a rear view, partly broken away, of the same unit, FIG. 4 is an axial sectional view through a second embodiment of a unit, FIG. 5 is a cross-sectional view taken on the line V—V of FIG. 4, FIG. 6 is a rear view of the unit of FIG. 4, FIG. 7 is an axial sectional view through a third embodiment of a unit, and FIG. 8 and FIG. 9 are cross-sectional views taken on the lines VIII—VIII and IX—IX, respectively, of FIG. 7.

An aluminium reflector body 1 in FIG. 1 has a necked portion 2 near the apex of a concave reflecting portion 33. An electric lamp 4 having a hard glass lamp envelope 5 has a pinch seal 6 with embedded therein molybdenum current supply conductors 7 and 8 extending from outside the lamp envelope 5 to a filament 9 accommodated therein.

Figure 2:
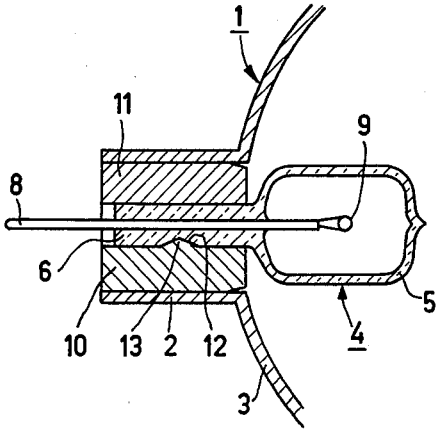
Figure 3:
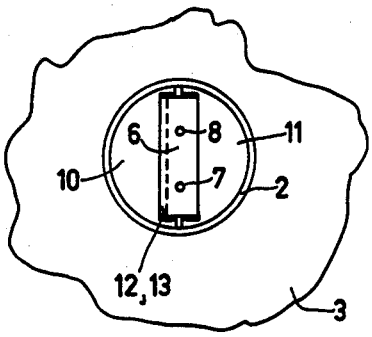

From FIGS. 1, 2 and 3, it can be seen that the pinch seal 6 is enclosed between moulded members 10 and 11, for example of brass. The pinch seal 6 has a profiled surface in the form of a V-shaped groove 12 extending transversely to the axis of the unit, while the moulded member 10 has a counter-profile in the form of a rib 13 which is in engagement with the groove 12 and keeps the lamp 4 locked against axial displacement relative to the moulded member 10.

After the moulded members 10 and 11 had been provided on the pinch seal 6 of the lamp 4, the lamp 4 with its filament 9 has been moved into the reflecting portion 3 of the reflector body 1 via the necked portion 2 over a previously-determined distance. The necked portion 2 of the reflector body 1 surrounds the moulded members 10 and 11 and the pinch seal 6 in a clamping manner and keeps the moulded members 10 and 11, and hence the lamp 4, fixed in the reflector body 1.

In FIG. 4 and FIG. 5 the pinch seal 6 has a profiled surface in the form of transverse grooves 24 and 25. The pinch seal 6 is surrounded by ceramic moulding members 20 and 21 which have a counter-profile in the form of ribs 22 and 23, respectively. These ribs each engage in a respective groove 24, 25 of the pinch seal 6.

The moulded members 20 and 21 (FIG. 4) have edges 28 and 29, respectively, which bear against the end of the neck-shaped reflector portion 2. In the outer surface of the moulded member 21 a recess 26 is present into which the necked reflector portion 2 has been depressed. In this manner the necked reflector portion 2 keeps the moulded members 20 and 21 and the lamp 4 fixed therein.

An electric cable 27 is connected to the current supply conductors 7 and 8 of the lamp 4. The moulded members 20 and 21 clamp the cable and thereby relieve any force exerted on the current supply conductors 7 and 8 by the cable (FIG. 6).

In FIG. 7 a reflector body 41 has a necked portion 42 at the apex of a concave reflecting portion 43. A discharge lamp 44 has a quartz glass lamp envelope 45 with a pinch seal 46 and current supply conductors 47, 47*a*, 47*b* and 48, 48*a* and 48*b*, respectively, partly embedded in the pinch seal 46, which extend towards a pair of electrodes 49.

From FIGS. 7, 8 and 9 it can be seen that the pinch seal 46 is enclosed between two ceramic moulded members 50 and 51. On its surface the pinch seal is profiled to form a rib 52 (FIG. 9) which is in engagement with counter-profile in moulded member 51 in the form of a recess 53 so that the lamp 44 is locked against movement. The moulded member 51 has another recess 56 (FIG. 9) in which the necked portion 42 of the reflector body 41 is indented, as a result of which the necked portion 42 keeps the lamp 44 with the moulded members 50 and 51 fixed in the necked portion.

The moulded member 51 has a rib 55 (FIGS. 7,8) which extends in a recess 54 in moulded member 50. As a result of this the moulded members are coupled together. Insulation sleeves 61 and 60, respectively, are provided around the current supply conductors 47 and 48 around which the moulded members 50 and 51 engage in a clamping manner. The weld between the current supply conductors parts 47, 48 and the foils 47*a* and 48*a*, respectively, is mechanically relieved thereby.

What is claimed is:

1. A lamp/reflector unit comprising a metal reflector body having a necked portion near the apex of a concave reflecting portion and also comprising an electric lamp having a glass lamp envelope with a pinch seal in which current supply conductors are embedded which extend from outside the lamp envelope to an electric element accommodated inside the lamp envelope, which pinch seal is fixed in the necked portion of the reflector body, characterized in that the pinch seal of the lamp envelope is enclosed laterally between at least two moulded members, the surface of the pinch seal is provided with a profiled portion which is in engagement with counter-profiled portion on at least one of the moulded members and keeps the lamp locked against axial movement, and that the necked portion of the reflector body keeps the lamp with the moulded members fixed in the reflector body.

2. A lamp/reflector unit as claimed in claim 1, characterized in that at least one of the moulded members has a flange which bears against the free end of the necked portion of the reflector body.

3. A lamp/reflector unit as claimed in claim 1 or 2, characterized in that the necked portion of the reflector body is indented into a recess in at least one of the moulded members.

4. A lamp/reflector unit as claimed in claims 1 or 2, characterized in that the moulded members consist of an electrically insulating material.

5. A lamp/reflector unit as claimed in claim 4, characterized in that the moulded members consist of ceramic.

6. A lamp/reflector unit as claimed in claim 4, characterized in that the moulded members enclose the current supply conductors of the lamp in a clamping manner.

7. A lamp/reflector unit as claimed claims 1 or 2, characterized in that the moulded members are coupled together by at least one recess and a rib which are in engagement with each other.

* * * * *